US005863029A

United States Patent [19]

Fänger et al.

[11] Patent Number: 5,863,029

[45] Date of Patent: Jan. 26, 1999

[54] SWIVELABLY MOUNTED ROPE GUIDE FOR GUIDING A ROPE ONTO AND OFF OF A WINDING DRUM

[75] Inventors: Alfred Fänger, Wetter; Udo Gersemsky, Herdecke, both of Germany

[73] Assignee: Mannesmann Aktiengesellschaft, Düsseldorf, Germany

[21] Appl. No.: 823,315

[22] Filed: Mar. 21, 1997

[30] Foreign Application Priority Data

Mar. 29, 1996 [DE] Germany ..... 196 13 712.8

[51] Int. Cl.[6] ..... B66D 1/00

[52] U.S. Cl. ..... 254/389; 254/278; 254/285; 254/336

[58] Field of Search ..... 254/285, 284, 254/286, 336, 337, 389; 242/615.3, 679.1, 388.6

[56] References Cited

U.S. PATENT DOCUMENTS

| | | | |
|---|---|---|---|
| 1,524,198 | 1/1925 | Morgan | 254/285 |
| 2,238,398 | 4/1941 | Reed | 254/389 |
| 2,347,885 | 5/1944 | Crickmer | 254/389 |
| 2,738,143 | 3/1956 | Hannay | 242/397.1 |
| 2,984,455 | 5/1961 | Rischer | 254/286 |
| 3,215,405 | 11/1965 | Walsh | 254/389 |
| 3,226,090 | 12/1965 | Sauerbrey | 254/284 |
| 3,866,718 | 2/1975 | Hiergeist | 242/388.6 |
| 3,877,660 | 4/1975 | Bernard | 242/388.6 |

FOREIGN PATENT DOCUMENTS

| | | |
|---|---|---|
| 41 908 | 10/1965 | Germany . |
| 23 43 953 | 3/1975 | Germany . |
| 42 41 655 | 4/1994 | Germany . |

*Primary Examiner*—Katherine Matecki
*Attorney, Agent, or Firm*—Cohen, Pontani, Lieberman & Pavane

[57] ABSTRACT

A rope guide for a winch, especially for hoisting gear, with a winding drum which has rope grooves running in opposite directions, including guide means which are provided for the alignment of at least a pair of rope lines and connected with one another via coupling means so as to run in opposite directions. The guide means include guide elements and are drivable by the rope lines, which can be wound on or wound off the winding drum. To facilitate a gentle winding on and winding off of the rope in a compact constructional form which is robust, resistant to impact and maintenance-free, each guide element comprises a rope guide channel which is formed in a channel support and which has, in a first plane disposed at a right angle to the axis of rotation of the winding drum and in a second plane disposed parallel to the axis of rotation of the winding drum, an input contact portion, for a rope and an oppositely located output contact portion for the rope. The respective input and output contact portions are configured to guide the rope line tangentially as it is wound off and wound on the winding drum.

17 Claims, 6 Drawing Sheets

6
3
45a
5a
45b
6b
6a
17
17a
R
5
55a
55b
16
15
5b
3
13

SWIVELABLY MOUNTED ROPE GUIDE FOR GUIDING A ROPE ONTO AND OFF OF A WINDING DRUM

BACKGROUND OF THE INVENTION

1. Field of the Invention

This invention relates to a rope guide for a winding mechanism or winch and, more particularly, to a rope guide which can gently wind and unwind a rope from a winding drum, particularly when the rope is being pulled diagonally, without the need for separate driving means.

2. Description of the Related Art

Rope guides of the type described herein are used on winches, especially those having winding drums with rope grooves, to prevent the hoisting rope from exceeding a permissible lateral deflection along the axis of rotation of the winding drum. These deviations or deflections occur, for example, as a result of a pendulum-like swinging of the load or due to diagonal tension on the rope. Experience has shown that the service life of the rope increases if such deflections are reduced.

German Patent Number DE 42 41 655 C1 discloses a rope guide in which a rail, including the guide elements, is swivelably suspended near the point at which the rope lines run tangentially off the winding drum. The rail is thereby swivelably adaptable to the deflecting movement of the rope lines transverse to the axis of rotation of the winding drum. As a result, the rope lines are gently guided without the need for additional driving means and the rope guide is robust and relatively inexpensive in terms of construction. However, the use of ball bearings to support the idler sheaves or guide rollers within the rope guide, as disclosed in this reference, limits the robustness, impact strength and freedom from maintenance of a rope guide constructed accordingly. Furthermore, the guide rollers disclosed in this reference are adaptable to only a limited number of conditions above and below the position of the rope guide.

There is accordingly a need for an inexpensive, robust and essentially maintenance free rope guide which readily adapts to transverse deflection of the rope and/or load.

SUMMARY OF THE INVENTION

The present invention is directed to a rope guide for a winch, in particular for a hoisting gear, which works without separate driving means and enables a gentle winding and unwinding of the rope on a winding drum, particularly when the rope is under diagonal tension, and which at the same time has a compact construction which is robust, resistant to impact and essentially maintenance-free.

The rope guide of the present invention includes a winding drum having rope grooves running in opposite directions and which is rotatably supported in a frame. The rope guide also includes guide means which are movable parallel to the axis of rotation of the winding drum on at least one rail and which align at least one of a pair of rope lines in relation to the rope groove associated therewith on the winding drum. The guide means comprise two guide elements comprising each having a channel support having a rope guide channel defined therethrough which has an input section and an output section for guiding the rope line tangentially through the associated rope guide channel as the rope is wound onto and off of the winding drum. The rope guide can also be adapted to the different guiding requirements, e.g., various orientations and winding positions of the rope above and below the guide, through suitable configuration of the input section and output sections The input section comprises oppositely disposed first and second input contact surfaces that lie on separate, non-parallel planes that extend parallel to the winding drum axis of rotation. Similarly, the output section comprises two oppositely disposed first and second output contact surfaces that lie on separate, non-parallel planes that extend parallel to the winding drum axis of rotation. The first input contact surface and the first output contact surface are parallel to each other, and the second input contact surface and the second output contact surface are parallel to each other. In addition, the first input contact surface and second output contact surface are located closer to the winding drum than are the second input contact surface and the first output contact surface. The input and output sections further respectively comprise oppositely disposed curved input and output contact surfaces that extend transverse to the winding drum axis of rotation. The input and output contact surfaces collectively define a rope guide channel for guiding the rope as it passes therethrough.

In accordance with the present invention that the input section and the output section are arranged such that they directly follow one another. Consequently, the input section passes directly and without interruption into the output section so that the rope contacts two oppositely located side surfaces within the rope guide channel i.e. an input contact surface and an output contact surface, thereby enabling an accurate and gentle guiding of the rope.

In particular, a good guiding of the rope is achieved in that the rope guide channel is so designed that the guided rope line contacts an input contact surface and an oppositely disposed output contact surface.

It is particularly advantageous for the guidance of the rope when the input contact surface facing toward the winding drum and the output contact surface facing away from the winding drum are substantially parallel to one another, which also enables a good guidance of the rope especially when the rope is pulled downward vertically.

In order to guide the rope dependably also at large pull-off angles transversely to the axis of rotation of the winding drum, the input contact surface facing away from of the winding drum and the output contact surface facing toward the winding drum are preferably constructed so as to extend substantially parallel to one another.

In order that the asymmetry of the load be taken into account more fully, the rope guide channel is preferably constructed in such a way that the guided rope line contacts the same surface in the input section and in the output section when the rope guide channel is viewed in cross-section along a plane that is parallel to the winding drum axis of rotation.

A gentle guiding of the rope is achieved in that the cross section of the rope guide channel is smallest in the middle region and then increases again toward the input and output sections. Thus, expressed in a visual sense, the rope guide channel is provided with a waist having a "focussing" effect with respect to the position of the rope, which results in a damping of rope oscillations. Further, the swiveling axis of the rope guide need no longer be situated at the height of the axis of rotation of the winding drum. The special shape of the inventive rope guide channel does not present an obstacle to the inevitable diagonal running of the wire rope.

The cross-section of the rope guide channel taken along a plane that is parallel to the winding drum axis of rotation thus increases in the direction of the input by a value that is less than the cross section of the rope. Owing to the virtually parallel contour in the oppositely disposed input contact surfaces, the rope is supported over a large surface area of the rope, resulting in a large wear volume and very favorable friction conditions in the principal loading direction.

Furthermore, the cross-section of the rope guide channel taken along a plane parallel to the axis of rotation of the winding drum increases symmetrically with respect to the axis of symmetry of the rope guide channel in the direction of the output. The sharply curved contour of the output section facilitates large predefinable radii of curvature of the rope without the distance between the rope and the rope drum being too great, e.g., because of large guide rollers.

The wear and loading of the rope by the rope guide channel can be reduced in that the cross-sectional line of the rope guide channel taken along a plane parallel to the axis of rotation of the winding drum in the output section is constructed so as to be curved in the direction of the output with increasing bending radius.

The guide means are connected with one another via coupling means so as to run toward or away from each other and are drivable by the rope lines as they are wound on and wound off the winding drum.

The rail is arranged at the winch for movement on a swiveling plane transverse to the axis of rotation of the winding drum. The rail is accordingly swivelable about an axis running parallel to the axis of rotation of the winding drum. This rope guide can be produced in a very simple and economical manner in that each guide element comprises a rope guide channel defined in a channel support—the channel support being formed of two identical support halves which contact one another. The rope guide of the present invention is also configured so that a half rope guide channel is constructed in the contacting side surfaces of the support halves to guide the rope virtually without bends in the dividing plane separating the support halves, this dividing plane lying in the swiveling plane of the rail or parallel thereto. This further increases the robustness, impact strength and freedom from maintenance due to the absence of ball bearings accompanied by a gentle guiding of the rope. Moreover, the rope guide can be adapted in almost any desired manner to the different guidance requirements, e.g., above and below the guide, by means of the rope guide channel which can be produced in a mechanically simple manner. Further, the solution according to the invention enables an appreciable simplification of the guide element and accordingly a reduction in manufacturing costs. The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
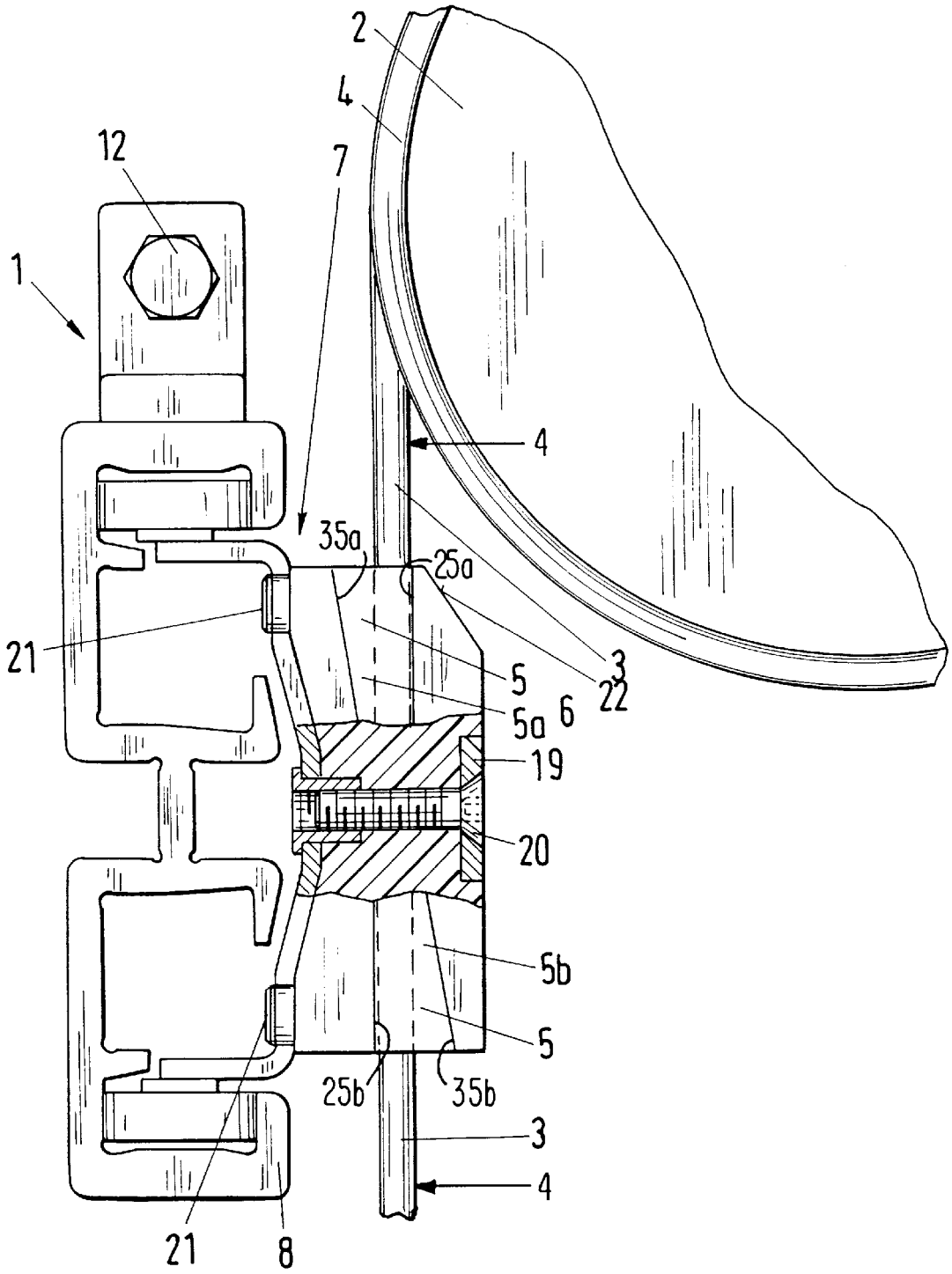
FIG. 1 is a partial cross-sectional side view of a rope guide configured in accordance with the present invention.

Referring now to the drawings, and in particular to FIGS. 1, 2 and 3 and 6 a diagrammatic representation of a rope guide configured in accordance with the present invention is generally depicted at 1. The rope guide 1 of the present invention is configured for use with a hoisting mechanism having a winding drum 2 which is rotatably supported at both ends in a frame 60. The winding drum 2 has two rope grooves 50 running in opposite directions, one for each rope line 3 of a rope 4 having two free ends which are fastened to longitudinally opposite end regions of the winding drum 2. From there, the rope 4 is guided through the rope grooves 50 and passes around the winding drum 2 toward the center of the winding drum 2 and, depending on the winding state of the winding drum 2, i.e. whether the drum 2 is winding or unwinding the rope 4, exits from or is wound onto the winding drum 2 tangent to the outer surface of the winding drum 2 at a location referred to as the runoff point. Subsequently, one rope line 3 runs freely off the winding drum 2 until it encounters and is guided by a rope guide channel 5 defined formed in a channel support 6 that is a component part of a guide element 7. After exiting the guide channel 5, the rope line 3 runs in the direction of a lower block 52, i.e. generally downward. The rope line 3 exiting from the lower block is guided back in the reverse sequence, i.e. upward through another rope guide channel 5, to the other end of the winding drum 2 to form a rope loop. The guide elements 7 are provided in pairs and are interconnected via coupling means 54 such that they are movable concurrently toward or away from each other on a rail 8 parallel to the axis of rotation of the winding drum 2. The rail 8 is suspended at the winch for movement on a swiveling plane transverse to the axis of rotation of the winding drum 2. The rail 8 is accordingly swivelable about a swiveling axis 12 extending parallel to the axis of rotation of the winding drum 2. The swiveling axis 12 is arranged at the frame 60 in the region of the ends of the winding drum 2 where the unused portion of the wound up rope 4 is located.

Figure 2:
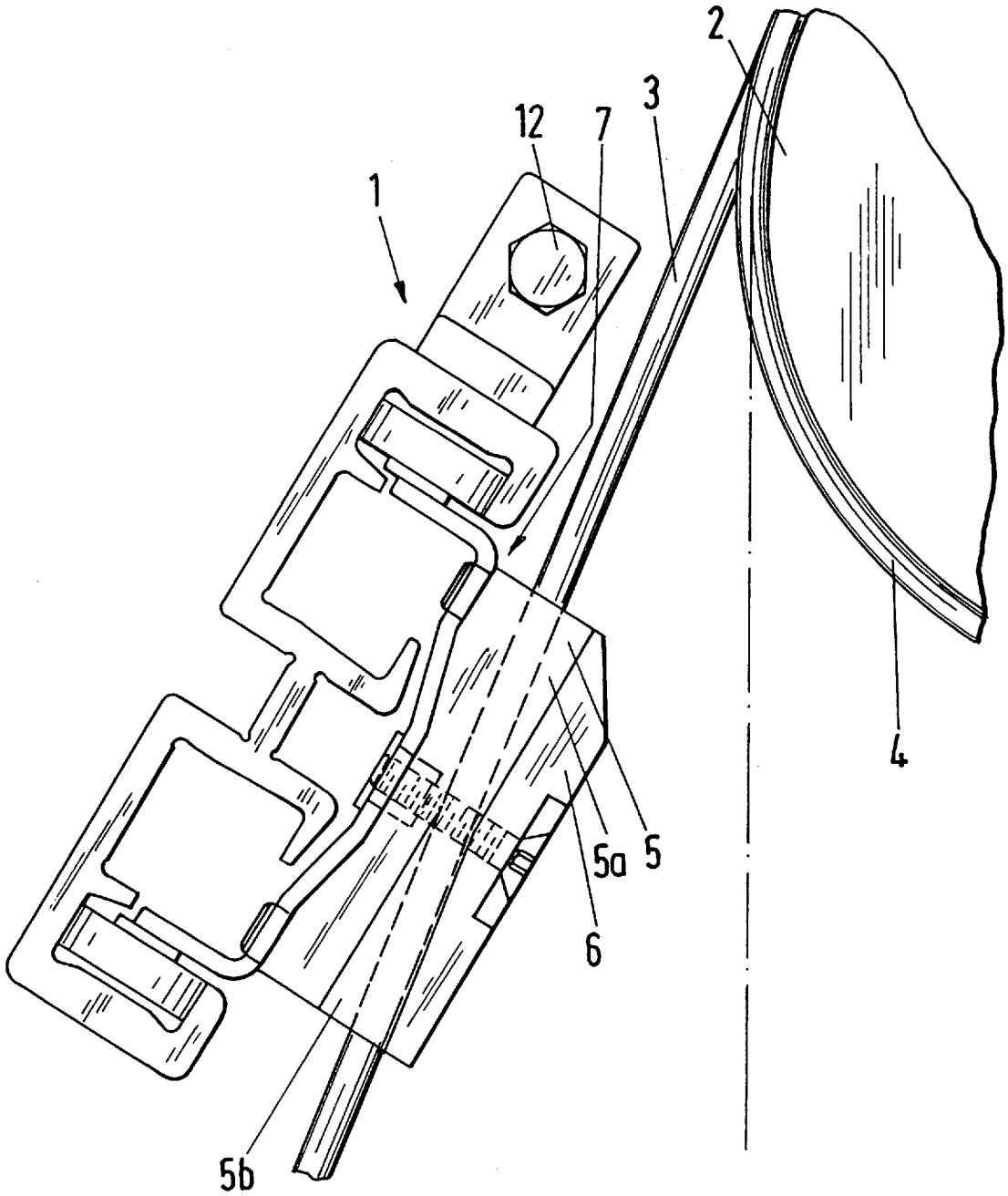
FIG. 2 is a side view of the rope guide of FIG. 1 illustrating a large pull-off angle.
Figure 3:
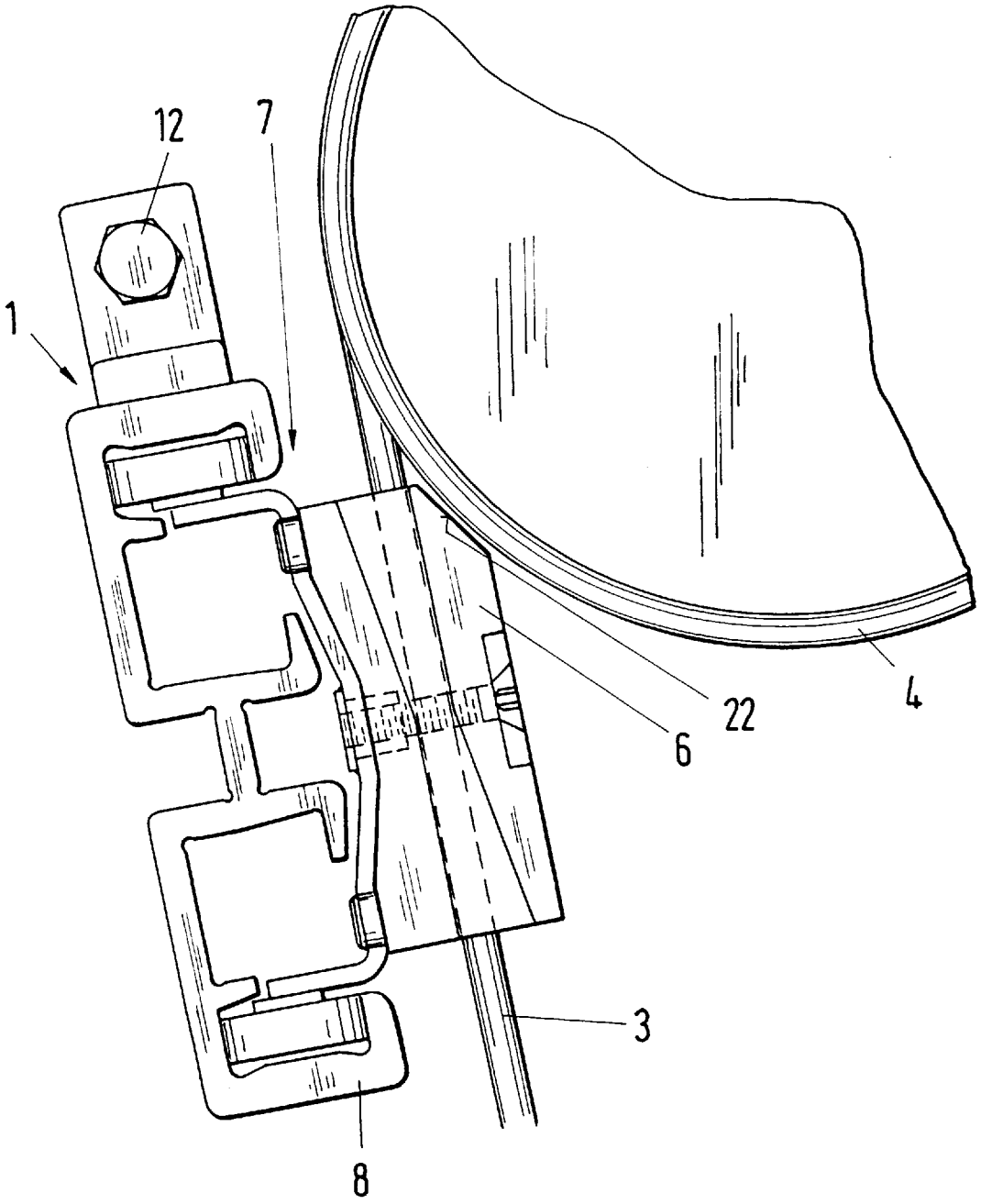
FIG. 3 is a side view of the rope guide of FIG. 1 illustrating a bevel on the channel support element of the rope guide contacting the winding drum.

Referring now to FIG. 1, a rope guide channel 5 of the present invention is depicted in partial cross-section. The rope guide channel 5 has an input section 5*a* having oppositely disposed first and second input contact surfaces 25*a*, 35*a*, and an output section 5*b* having oppositely disposed first and second output contact surfaces 25*b*, 35*b*. In a preferred embodiment, first input contact surface 25*a* is located closer to the winding drum 2 than second input contact surface 35*a* and is parallel with first output contact surface 25*b*. Second output contact surface 35*b* is located closer to the winding drum 2 than second output contact surface 25 and is parallel with second input contact surface 35*a*. Consequently, input contact surfaces 25*a*, 35*a* are not parallel with each other—nor are output contact surfaces 25*b*, 35*b*—and the cross-sectional shape of the rope guide channel 5, when viewed as in FIGS. 1, 2 and 3, narrows in the middle region thereof. As shown in FIGS. 1, 2 and 3, the rope line 3 is guided through the rope guide channel 5 virtually without bending and contacts opposite sides of the input and output sections 5*a*, 5*b*, e.g. first input contact surface 25*a* and first output contact surface 25*b* or second input contact surface 35*a* and second output contact surface 35*b*, regardless of the angle at which the rope line 3 exits the winding drum 2—the angle being different in FIGS. 1, 2 and 3. Input contact surfaces 25*a*, 35*a* and output contact surfaces 25*b*, 35*b*, lie on planes that are parallel to the winding drum 2 axis of rotation. As seen more clearly in FIG. 2, the input section 5*a* and output section 5*b* are continuous with one another.

The cross-section of the rope guide channel 5 in the first plane is smallest in a middle region of the rope guide channel 5, defined between the input and output, and increases continuously toward the input and output.

Figure 4:
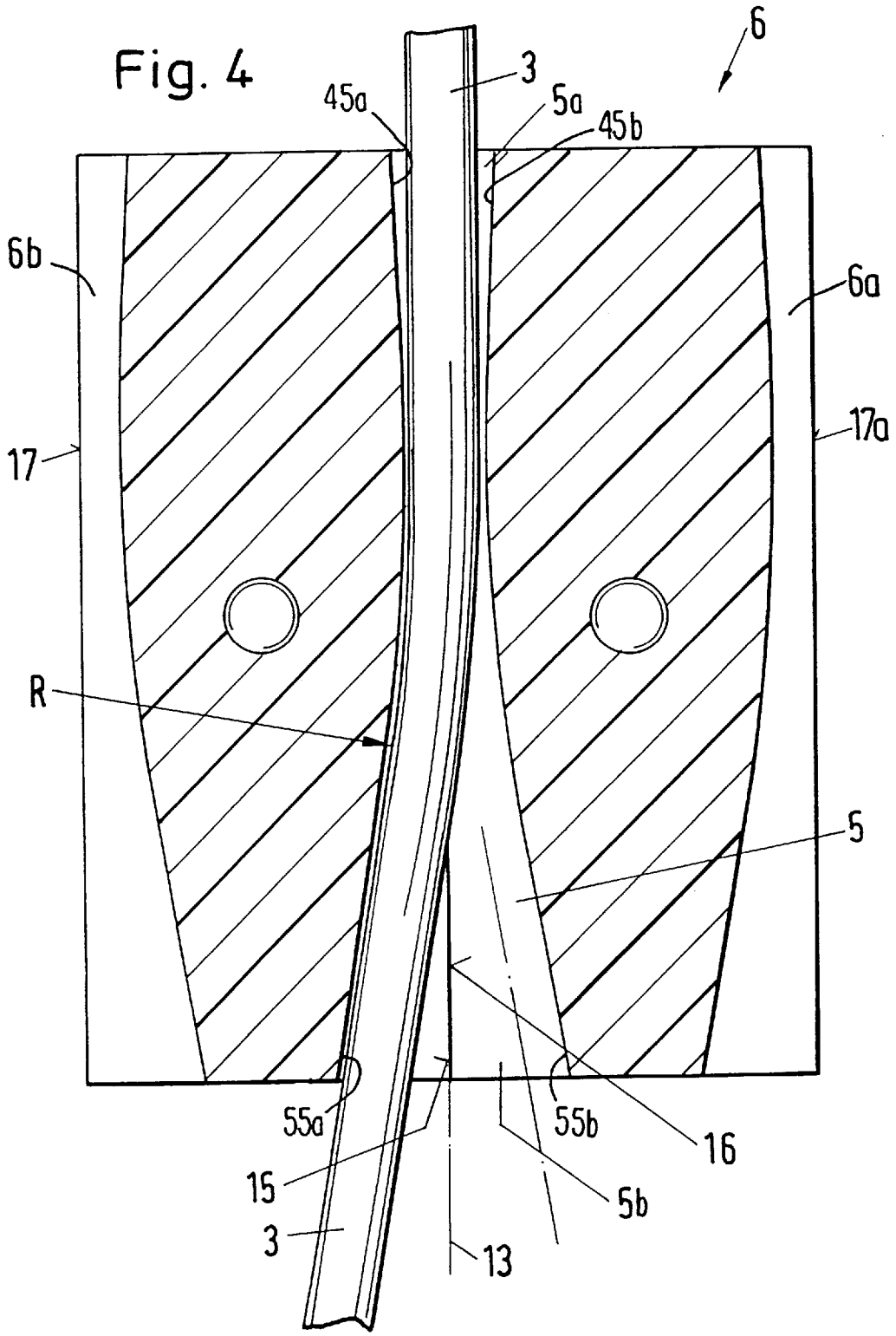
FIG. 4 is a cross-sectional view of the channel support element of the rope guide taken along line 4—4 of FIG. 1.

FIG. 4 depicts a cross-sectional view of the channel support 6 taken along the line 4—4 of FIG. 1. The input section 5*a* of the rope guide channel 5 further comprises oppositely disposed, curved first and second input contact surfaces 45*a*, 45*b* and the output section 5*b* further comprises oppositely disposed, curved first and second output contact surfaces 55*a*, 55*b*. The curved input and output contact surfaces 45*a*, 45*b* and 55*a*, 55*b* curve toward each other moving in a direction from the input and output sections 5*a*, 5*b* toward the middle region of the rope guide channel 5 (when viewed as in FIG. 4), and, consequently, curve away from each other when moving in a direction away from the middle region toward the input and output sections 5*a*, 5*b*. The curved input and output contact surfaces 45*a*, 45*b* and 55*a*, 55*b* extend transverse to the winding drum 2 axis of rotation, and are continuous with each other. As shown more clearly in FIG. 4, the curved cross-sectional shape of the rope guide channel 5 causes the rope line 3 to be guided by either the curved first input and output contact surfaces 45*a*, 55*a*, or, alternatively by the curved second input and output contact surfaces 45*b*, 55*b* as the rope line 3 is guided through the rope guide channel 5.

It is thereby possible to gently guide the rope because the cross-sectional shape of the rope guide channel 5, when viewed as in in both FIGS. 1 and 4, is smallest in the middle region and then increases again toward the input and output sections 5*a*, 5*b*. Thus, the cross-sectional profile of the rope guide channel 5, tends to focus the position of the rope line 3 as it is guided through the channel 5 toward the narrower mid-section of the rope guide channel 5, which in turn, dampens oscillation of the rope line 3.

With continued reference to FIG. 4, and moving in a direction from the middle region toward the input section 5*a* of the guide channel 5, the cross section of the rope guide channel 5 increases, starting from the smallest cross section in the middle region, by a value which is less than the cross section of the rope line 3. Similarly, moving in a direction from the middle region toward the output section 5*b* of the guide channel 5, the cross section of the rope guide channel 5 increases symmetrical to an axis of symmetry 13, wherein the output contact surface 45*b* is curved toward the output of the rope guide channel 5 with an increasing bending radius R. The increasing output section 5*b* is sharply curved to facilitate a large predefinable radii of curvature of the rope line 3 running off the winding drum 2 without the distance between the rope line 3 and the winding drum 2 being too large, e.g., as is the case when large guide rollers are used.

The rope guide 1 of the present invention is adaptable to a variety of changing conditions and requirements due to the cross-sectional configuration of the rope guide channel 5. Specifically, the fact that the cross-section of the rope guide channel 5 increases in the direction of the input by a value that is less than the cross-sectional diameter of the rope line 3. In addition, the input section 5*a* comprises essentially parallel walls i.e. input contact surfaces 45*a*, 45*b* which resulting support a relatively large surface area of the rope line 3. As a result, the rope line 3 is subject to small frictional conditions and to a substantially large wear volume in the principal loading direction as the rope line 3 passes through the input 5*a*. Parallel walls also tend to cause the rope line 3 to wind off and on the winding drum 2 at runoff points tangent to the outer surface of the winding drum 2.

With continual reference to FIG. 4, the guide elements 7 are formed of channel supports 6 which are constructed as two identical contacting support halves 6*a*, 6*b* separated by a dividing plane disposed in or parallel to the swiveling plane of the rail 8. A half rope guide channel 5 is formed on each of the contacting side surfaces 15, 16 of the support halves 6*a*, 6*b* such that the rope line 3 is guided virtually without bending through the input section 5*a* in the dividing plane separating the support halves 6*a*, 6*b*. In a preferred embodiment, side surfaces 17, 17*a* located opposite to the contacting side surfaces 15, 16 of the support halves 6*a*, 6*b* also define a half rope guide channel 5.

In a preferred embodiment, the side surfaces 17, 17*a* located opposite to the contacting side surfaces 15, 16 of the support halves are parallel to one another and additionally have a half rope guide channel 5 formed thereon. Thus, it is possible to recycle support halves 6*a*, 6*b* having worn rope guide channels 5 simply by reconnecting the support halves 6*a*, 6*b* to utilize the unused half rope guide channel 5 defined by the side surfaces 17, 17*a*. The support halves 6*a*, 6*b* of the present invention can thus be used twice as long.

Figure 5:
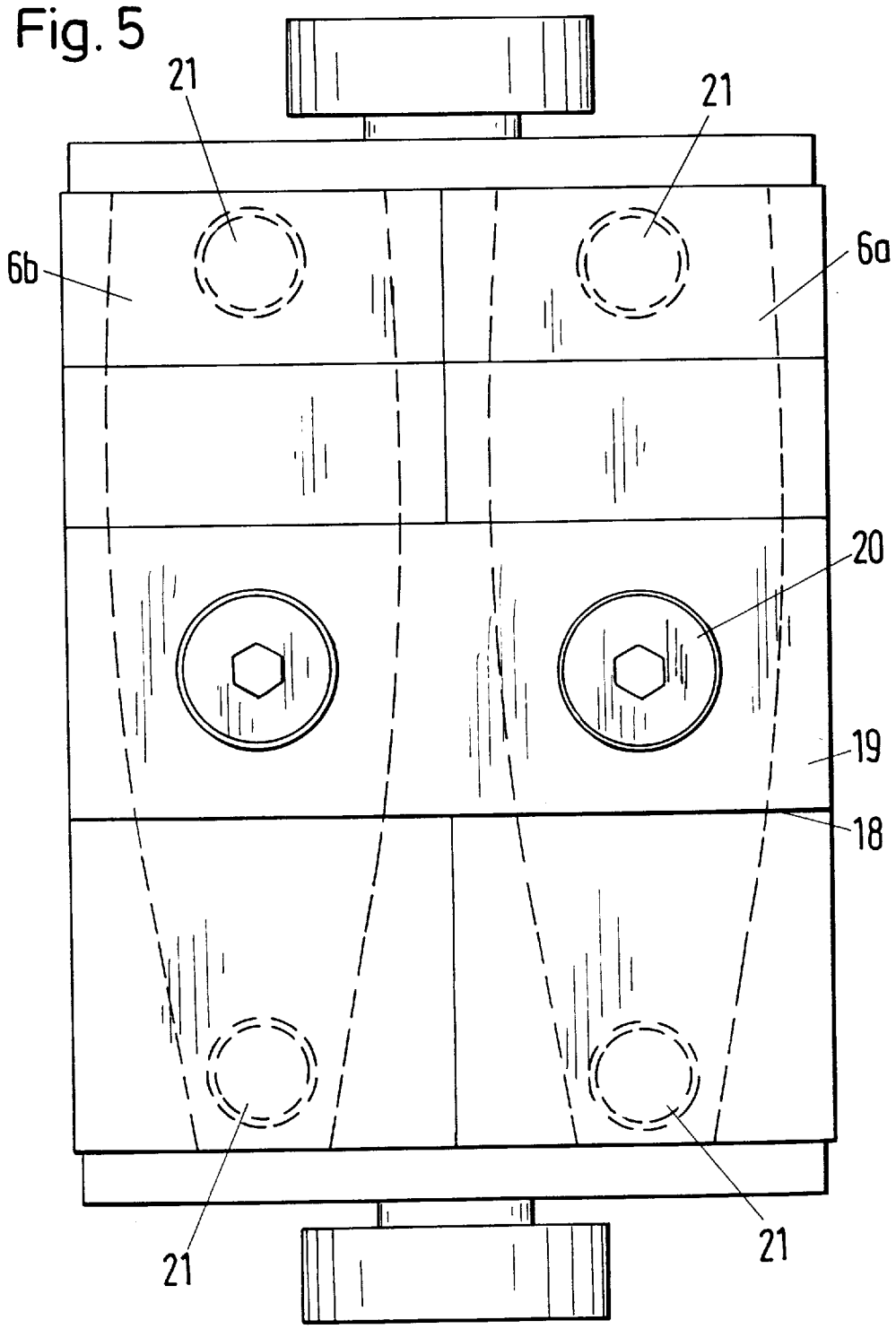
FIG. 5 is a front view of the channel support element of the rope guide of FIG. 1.
Figure 6:
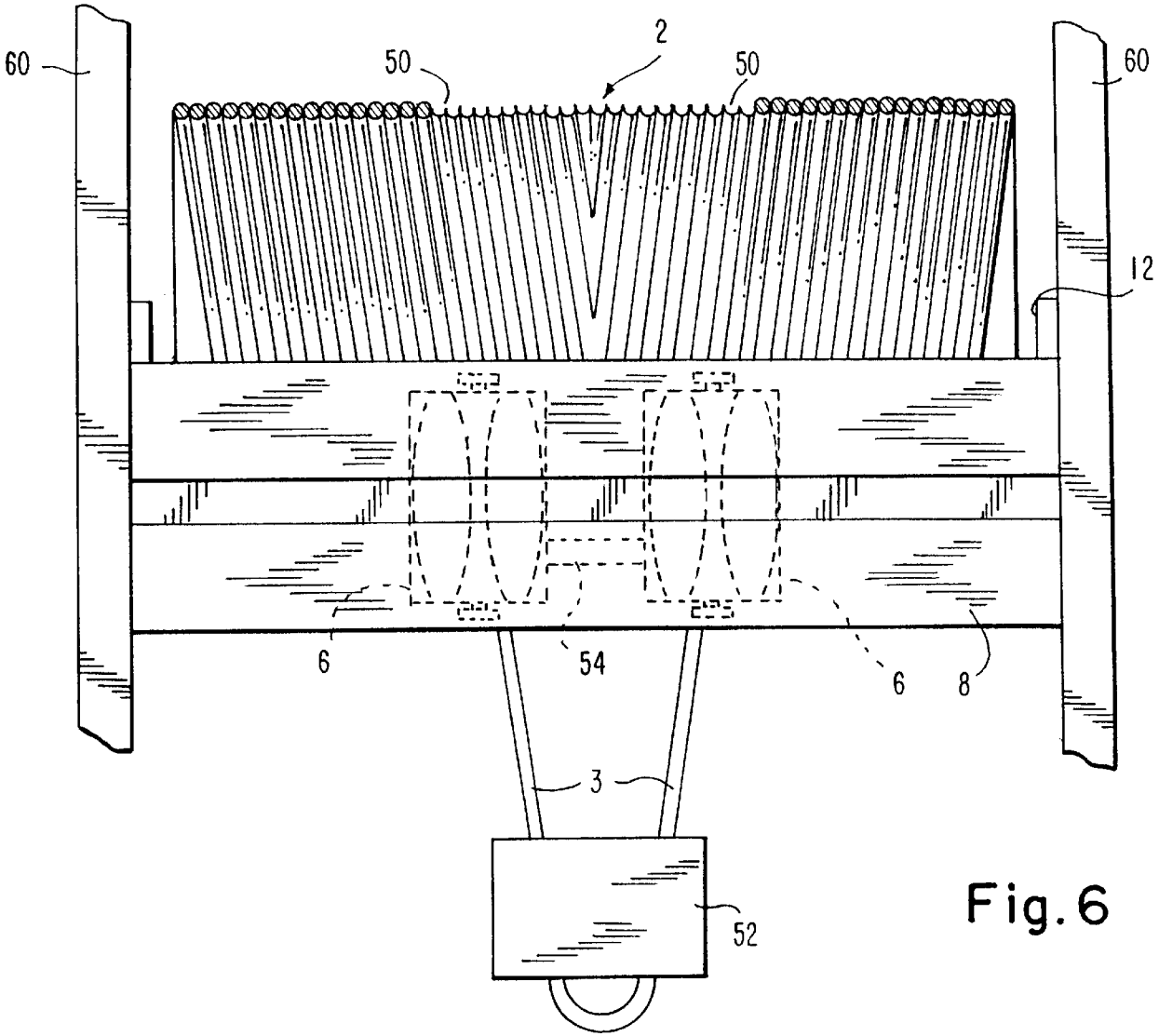
FIG. 6 is a front view of a rope guide configured in accordance with the present invention.

In a further preferred embodiment, and as shown more clearly in FIG. 5, each support half 6*a*, 6*b* of the channel support 6 includes an aligned groove 18 defined transverse to the longitudinal axis of the rope guide channel 5 and configured for accepting a positively engaging connection element 19. A screw 20 is provided for each support half 6*a*, 6*b* to fasten the connection element 19 thereto, thereby improving the stability of the connected support halves 6*a*, 6*b*. In addition, cams 21 are fastened to the support halves 6*a*, 6*b*. As is shown in FIG. 1, the cams 21 engage in a complementary recess of the guide element 7 to prevent the rotation of the channel support 6.

The edge of the channel support 6 facing the winding drum 2 preferably includes a bevel 22 (See FIGS. 1 to 3). As shown more clearly in FIG. 3, the bevel 22 runs substantially parallel to the tangential plane of the outer surface of the winding drum 2 when the rope guide 1 is swiveled about swivel axis 12 in response to a load condition so that the winding drum 2 and bevel 22 contact each other.

The channel support 6 is preferably constructed from a material which is softer than the rope 4 such as, for example, plastic, especially polyamide, or relatively soft metals such as aluminum.

The invention is not limited by the embodiments described above which are presented as examples only but can be modified in various ways within the scope of protection defined by the appended patent claims.

What is claimed is:

1. A rope guide for a winch including a winding drum having rope grooves running in opposite directions about its circumference for winding a rope thereabout, the rope having a cross-sectional diameter and comprising two rope lines, each rope groove being configured to accept one of the rope lines as the rope line is wound onto and wound off of the winding drum at a runoff point, the winding drum being rotatably supported in a frame for rotation about a winding drum axis, said rope guide comprising:

a rail swivelably connected to the frame for swivelable movement about a swiveling axis in a direction transverse to the winding drum axis, said swiveling axis being parallel to the winding drum axis;

two guide means for aligning each one of the rope lines with the rope groove associated therewith, said two guide means being movable toward and away from each other on said rail in a direction parallel to the winding drum axis by the rope lines as they are wound onto and wound off of the winding drum; and coupling means for connecting said two guide means to each other for movement toward and away from each other as the rope lines are wound onto and wound off of the winding drum;

said guide means each further comprising a guide element including a channel support having a rope guide channel defined therethrough, said rope guide channel further comprising an input section and an output section, said input section having first and second input contact surfaces disposed opposite each other, said output section having first and second output contact surfaces disposed opposite each other, said input and said output contact surfaces extending along planes that are parallel to the winding drum axis, said input section further having first and second curved input contact surfaces disposed opposite each other, said output section further having first and second curved output contact surfaces disposed opposite each other, said curved input and said curved output contact surfaces extending transverse to the winding drum axis, said rope guide channel guiding the rope lines tangential to the runoff point of the rope lines from the winding drum.

2. The rope guide of claim 1, wherein said input contact surfaces are continuous with said output contact surfaces.

3. The rope guide of claim 1, wherein said rope guide channel guides each rope line contactingly along one of said first and said second input contact surfaces and one of said first and said second curved input contact surfaces, and along one of said first and said second output contact surfaces and one of said first and said second curved output contact surfaces.

4. The rope guide of claim 1, wherein each rope line is contactingly guided through said input section by one of said first and said second input contact surfaces and through said output section by one of said first and said second output contact surfaces disposed opposite said one of said first and said second input contact surfaces.

5. The rope guide of claim 1, wherein said second input contact surface faces towards the winding drum and wherein said second output contact surface faces away from the winding drum, said second input contact surface and said second output contact surface being substantially parallel to each other.

6. The rope guide of claim 5, wherein said first input contact surface faces away from the winding drum and wherein said first output contact surface faces toward the winding drum, said first input contact surface and said first output contact surface being substantially parallel to each other.

7. The rope guide of claim 1, wherein the rope lines contact said first curved output contact surface when the rope lines contact said first curved input surface, and wherein the rope lines contact said second curved output contact surface when the rope lines contact said second curved input surface.

8. The rope guide of claim 1, wherein said rope guide channel includes a middle region located between said input section and said output section, said middle region being narrower than said input and said output sections.

9. The rope guide of claim 1, wherein said rope guide channel includes a middle region located between said input section and said output section, said first and said second curved input contact surfaces curving away from each other when moving in a direction from said middle region toward said input section so as to increase the width of said rope guide channel by an amount that is less than the cross-sectional diameter of the rope.

10. The rope guide of claim 1, wherein said rope guide channel has an axis of symmetry and includes a middle region, said first and said second curved output contact surfaces symmetrically curving away from each other moving in a direction from said middle region towards said output section so as to symmetrically increase the width of said rope guide channel between said first and said second curved output contact surfaces.

11. The rope guide of claim 10, wherein said first and said second curved output contact surfaces curve away from each other in said output section at a predefined bend radius that increases when moving from said middle region towards said output section.

12. The rope guide of claim 1, wherein said channel support is made from a material that is softer than the rope line.

13. The rope guide of claim 1, wherein said channel support further comprises a bevelled edge, said bevelled edge permitting swivelable movement of said guide element about said swiveling axis toward the winding drum without interference between said guide element and the winding drum.

14. A rope guide for a winch including a winding drum having rope grooves running in opposite directions about its circumference for winding a rope thereabout, the rope having a cross-sectional diameter and comprising two rope lines, each rope groove being configured to accept one of the rope lines as it is wound onto and wound off of the winding drum at a runoff point, the winding drum being rotatably supported in a frame for rotation about a winding drum axis, said rope guide comprising:

a rail swivelably connected to the frame for swivelable movement in a direction transverse to the winding drum axis about a swiveling axis parallel to the winding drum axis;

two guide means for aligning each one of the rope lines with the groove associated therewith, said two guide means being movable toward and away from each other on said rail in a direction parallel to the winding drum axis by the rope lines as they are wound onto and wound off of the winding drum; and coupling means for connecting said two guide means to each other for movement toward and away from each other as the rope is wound onto and wound off of the winding drum;

said guide means each further comprising a guide element including a channel support having a rope guide channel defined therethrough, said channel support further comprising identical contacting first and second support halves having contacting side surfaces each having one-half of a rope guide channel defined thereon, said identical first and second support halves having a dividing plane disposed parallel to the winding drum axis defined therebetween, the rope being guided through said rope guide channel virtually without bending along said dividing plane.

15. The rope guide of claim 14, wherein said identical first and second support halves each further comprise an opposite side surface disposed opposite said contacting side surface and parallel to each other, each of said opposite side surfaces having a half rope guide channel defined thereon.

16. The rope guide of claim 14, wherein said guide channel defines a longitudinal axis, said identical first and second support halves each having a groove defined therein that is disposed transverse to said longitudinal axis of said guide channel, said rope guide further comprising a connection element sized and shaped for insertion into said groove for positive engagement therewith, said connecting element connecting said identical first and second support halves.

17. The rope guide of claim 14, wherein said guide element includes a plurality of recesses defined therein, said identical first and second support halves each further comprising a cam configured for complementary positive engagement with each of said plurality of recesses, said complementary positive engagement restricting the rotation of said identical first and second support halves with respect to each other.

* * * * *